US011058174B2

(12) United States Patent
Hale

(10) Patent No.: US 11,058,174 B2
(45) Date of Patent: Jul. 13, 2021

(54) FOOTWEAR SOLE STRUCTURE

(71) Applicant: NIKE, Inc., Beaverton, OR (US)

(72) Inventor: Geoff S. Hale, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 251 days.

(21) Appl. No.: 16/230,071

(22) Filed: Dec. 21, 2018

(65) Prior Publication Data

US 2019/0200700 A1 Jul. 4, 2019

Related U.S. Application Data

(60) Provisional application No. 62/611,584, filed on Dec. 29, 2017.

(51) Int. Cl.

| | |
|---|---|
| ***A43B 13/20*** | (2006.01) |
| ***A43B 13/18*** | (2006.01) |
| ***A43B 13/12*** | (2006.01) |
| ***A43B 7/14*** | (2006.01) |
| ***A43B 13/04*** | (2006.01) |
| ***A43B 13/16*** | (2006.01) |
| *A43B 1/00* | (2006.01) |

(52) U.S. Cl.

CPC ..... *A43B 13/20* (2013.01); *A43B 7/1405* (2013.01); *A43B 13/04* (2013.01); *A43B 13/125* (2013.01); *A43B 13/127* (2013.01); *A43B 13/16* (2013.01); *A43B 13/189* (2013.01); *A43B 1/0072* (2013.01)

(58) Field of Classification Search

CPC ..... A43B 13/20; A43B 13/203; A43B 13/206; A43B 13/125; A43B 13/127; A43B 13/16; A43B 13/189; A43B 7/1405; A43B 17/03; A43B 17/035; A43B 21/28; A43B 21/285; A43B 5/0407

USPC ..... 36/29

See application file for complete search history.

(56) References Cited

U.S. PATENT DOCUMENTS

| | | | | |
|---|---|---|---|---|
| 2,253,959 | A | 8/1941 | Margolin | |
| 2,300,681 | A | 11/1942 | Margolin | |
| 4,878,300 | A | 11/1989 | Bogaty | |
| 5,341,581 | A * | 8/1994 | Huang | A43B 13/203 36/29 |
| 5,363,570 | A | 11/1994 | Allen et al. | |
| 5,402,588 | A | 4/1995 | Graham et al. | |
| 5,685,090 | A | 11/1997 | Tawney et al. | |
| 5,701,687 | A * | 12/1997 | Schmidt | A43B 13/20 36/29 |
| 5,706,589 | A | 1/1998 | Marc | |

(Continued)

FOREIGN PATENT DOCUMENTS

CN 106604657 A 4/2017

OTHER PUBLICATIONS

European Patent Office as the International Searching Authority, International Search Report and Written Opinion for Application No. PCT/US2018/067272, dated Apr. 1, 2019.

(Continued)

*Primary Examiner* — Ted Kavanaugh

(74) *Attorney, Agent, or Firm* — Honigman LLP; Matthew H. Szalach; Jonathan O'Brien

(57) ABSTRACT

An article of footwear is provided and includes an upper, a fluid-filled chamber including a first portion in contact with the upper in a first region, and a midsole including a first portion disposed between the fluid-filled chamber and the upper in a second region.

20 Claims, 11 Drawing Sheets

(56) References Cited

U.S. PATENT DOCUMENTS

| | | | |
|---|---|---|---|
| 5,815,949 | A | 10/1998 | Sessa |
| 5,860,226 | A | 1/1999 | Graham et al. |
| 6,253,466 | B1 | 7/2001 | Harmon-Weiss et al. |
| 6,684,532 | B2 | 2/2004 | Greene et al. |
| 6,775,930 | B2 | 8/2004 | Fuerst |
| 7,013,583 | B2 | 3/2006 | Greene et al. |
| 7,757,409 | B2 | 7/2010 | Snow et al. |
| 8,166,673 | B2 | 5/2012 | Sills |
| 8,316,560 | B2 | 11/2012 | Caron et al. |
| 8,347,526 | B2 | 1/2013 | Goldston et al. |
| 8,490,297 | B2 | 7/2013 | Guerra |
| 8,621,766 | B2 | 1/2014 | Goldston et al. |
| 8,707,583 | B2 | 4/2014 | Caron et al. |
| 8,732,983 | B2 | 5/2014 | Goldston et al. |
| 8,752,306 | B2 | 6/2014 | Goldston et al. |
| 9,456,658 | B2 | 10/2016 | Bruce et al. |
| 9,516,919 | B2 | 12/2016 | Ernst et al. |
| 2004/0163280 | A1* | 8/2004 | Morris ..... A43B 7/1445 36/28 |
| 2004/0211085 | A1* | 10/2004 | Passke ..... F16K 15/202 36/3 B |
| 2007/0119075 | A1 | 5/2007 | Schindler et al. |
| 2012/0198729 | A1 | 8/2012 | Graziani et al. |
| 2014/0075777 | A1 | 3/2014 | Bruce et al. |
| 2014/0075778 | A1 | 3/2014 | Bruce et al. |
| 2014/0165427 | A1* | 6/2014 | Molyneux ..... A43B 21/26 36/102 |
| 2016/0073732 | A1 | 3/2016 | Ernst et al. |
| 2016/0295966 | A1 | 10/2016 | Hensley et al. |
| 2016/0360831 | A1 | 12/2016 | Bruce et al. |
| 2017/0095033 | A1 | 4/2017 | Farina et al. |
| 2017/0095034 | A1 | 4/2017 | Dupre et al. |

OTHER PUBLICATIONS

Chinese Office Action for Application 201880084771.X dated Apr. 29, 2021.

* cited by examiner

FOOTWEAR SOLE STRUCTURE

CROSS REFERENCE TO RELATED APPLICATIONS

This non-provisional U.S. patent application claims priority under 35 U.S.C. § 119(e) to U.S. Provisional Patent Application Ser. No. 62/611,584, filed Dec. 29, 2017, the disclosure of which is hereby incorporated by reference in its entirety.

FIELD

The present disclosure relates generally to articles of footwear and more particularly to a sole structure for an article of footwear.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a stacked arrangement extending between a ground surface and the upper. One layer of the sole structure includes an outsole that provides abrasion-resistance and traction with the ground surface. The outsole may be formed from rubber or other materials that impart durability and wear-resistance, as well as enhancing traction with the ground surface. Another layer of the sole structure includes a midsole disposed between the outsole and the upper.

While existing sole structures perform adequately for their intended purpose, improvements to sole structures are continuously being sought in order to advance the arts.

DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
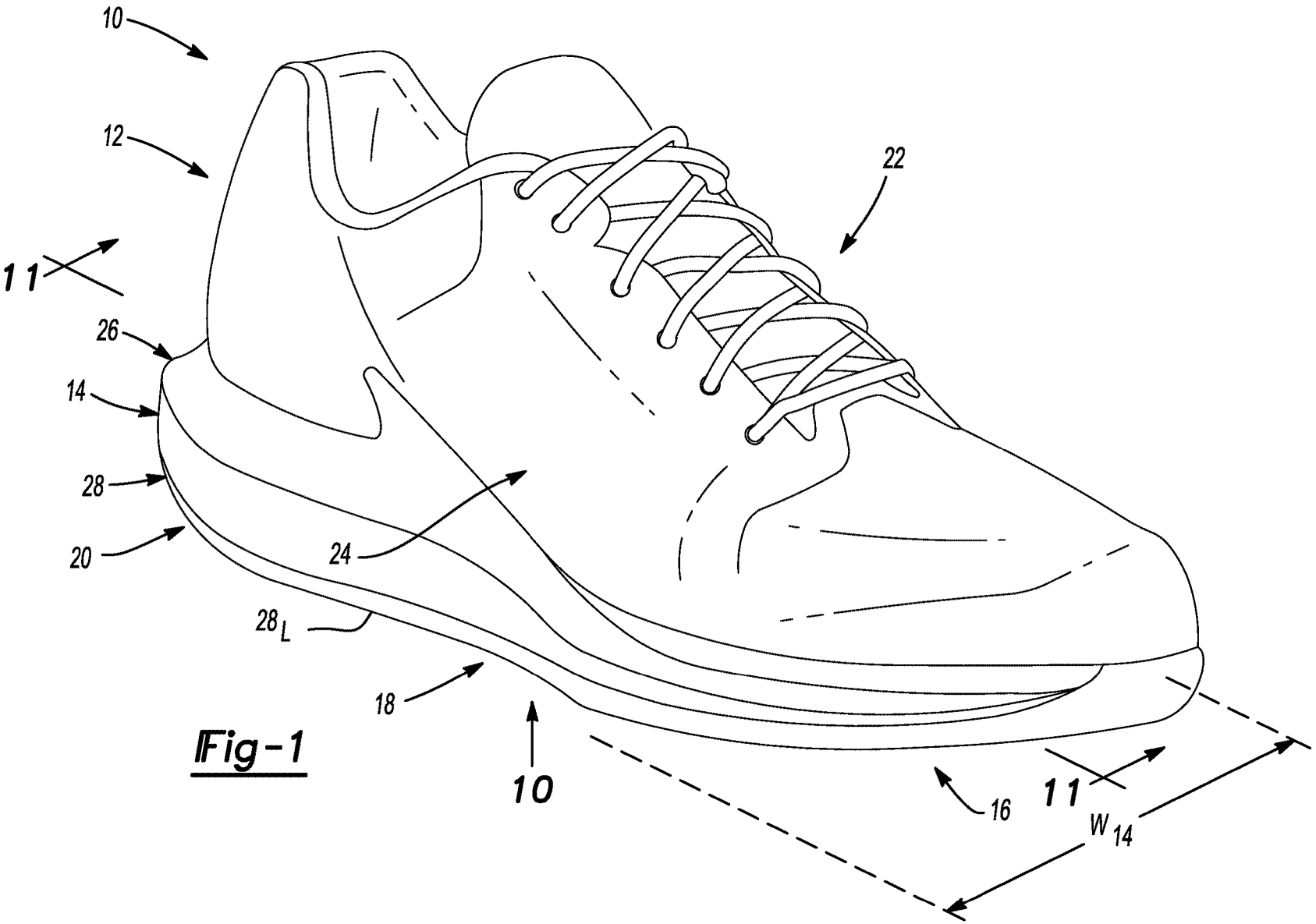
FIG. 1 is a perspective view of an article of footwear incorporating a sole structure in accordance with the principles of the present disclosure.
Figure 2:
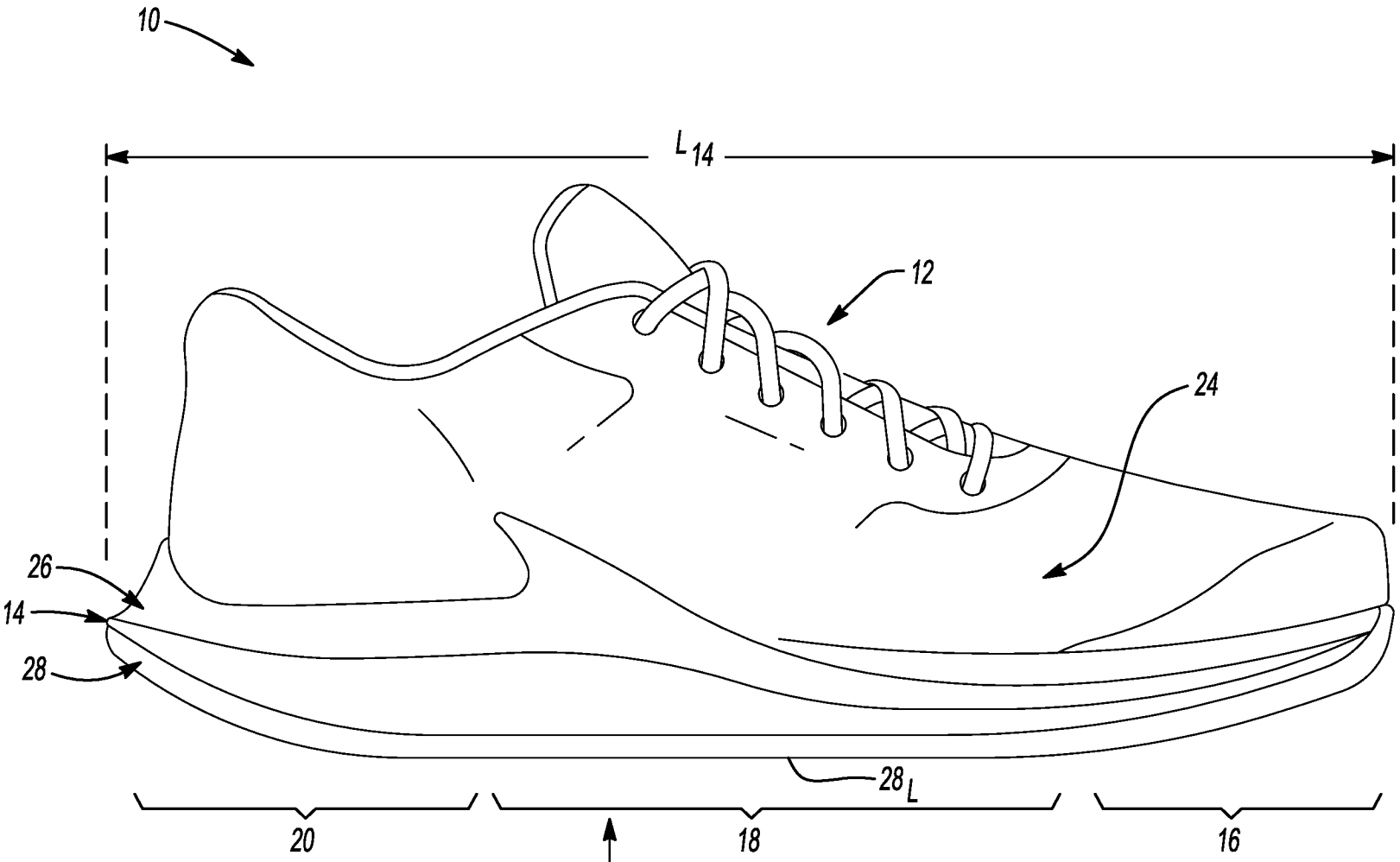
FIG. 2 is a side view of the article of footwear of FIG. 1.

The present disclosure is directed to an article of footwear including a sole structure that provides a wearer with improved performance during use. Namely, the sole structure incorporates a cushioning arrangement that provides the user with a forward camber effect that assists in maintaining a user's weight on a forefoot portion of the sole structure. In so doing, the sole structure provides the sensation that the user is biased forward, thereby encouraging forward movement.

Example embodiments will now be described more fully with reference to the accompanying drawings. Example embodiments are provided so that this disclosure will be thorough, and will fully convey the scope of those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of moded features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or sheet is referred to as being "on," "engaged to," "connected to," or "coupled to" another element or sheet, it may be directly on, engaged, connected or coupled to the other element or sheet, or intervening elements or sheets may be present. In contrast, when an element is referred to as being "directly on," "directly engaged to," "directly connected to," or "directly coupled to" another element or sheet, there may be no intervening elements or sheets present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, sheets and/or sections, these elements, components, regions, sheets and/or sections should not be limited by these terms. These terms may be only used to distinguish one element, component, region, sheet or section from another region, sheet or section. Terms such as "first," "second," and other numerical terms when used herein do not imply a sequence or order unless clearly indicated by the context. Thus, a first element, component, region, sheet or section discussed below could be termed a second element, component, region, sheet or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

In one configuration, an article of footwear is provided and includes an upper, a fluid-filled chamber including a first portion in contact with the upper in a first region, and a midsole including a first portion disposed between the fluid-filled chamber and the upper in a second region.

The first region may be a heel region of the article of footwear. Additionally or alternatively, the second region may be a forefoot region of the article of footwear.

The first portion of the fluid-filled chamber may be in contact with a strobel of the upper in the first region. Additionally, the fluid-filled chamber may be spaced apart from the strobel in the second region by the midsole.

The fluid-filled chamber may include an arcuate shape in a direction extending from a heel region of the article of footwear toward a forefoot region of the article of footwear. Additionally or alternatively, the fluid-filled chamber may be disposed closer to the upper within a heel region of the article of footwear than in a forefoot region of the article of footwear.

A tensile element may be disposed within the fluid-filled chamber. Additionally or alternatively, at least a portion of the fluid-filled chamber may be visible at an opening of the ground-contacting surface.

In another configuration, an article of footwear is provided and includes an upper having a strobel and a fluid-filled chamber including a first portion in contact with the strobel and a second portion spaced apart from the strobel.

The article of footwear may additionally include a midsole having a first portion disposed between the second portion of the fluid-filled chamber and the strobel.

The first portion may be disposed in a heel region of the article of footwear. Additionally or alternatively, the second portion may be disposed in a forefoot region of the article of footwear.

The fluid-filled chamber may include an arcuate shape in a direction extending from a heel region of the article of footwear toward a forefoot region of the article of footwear. Additionally or alternatively, the fluid-filled chamber may be disposed closer to the upper within a heel region of the article of footwear than in a forefoot region of the article of footwear.

A tensile element may be disposed within the fluid-filled chamber. Additionally or alternatively, at least a portion of the fluid-filled chamber may be visible at an opening of the ground-contacting surface.

The fluid-filled chamber may extend continuously from the first portion to the second portion.

Figure 11:
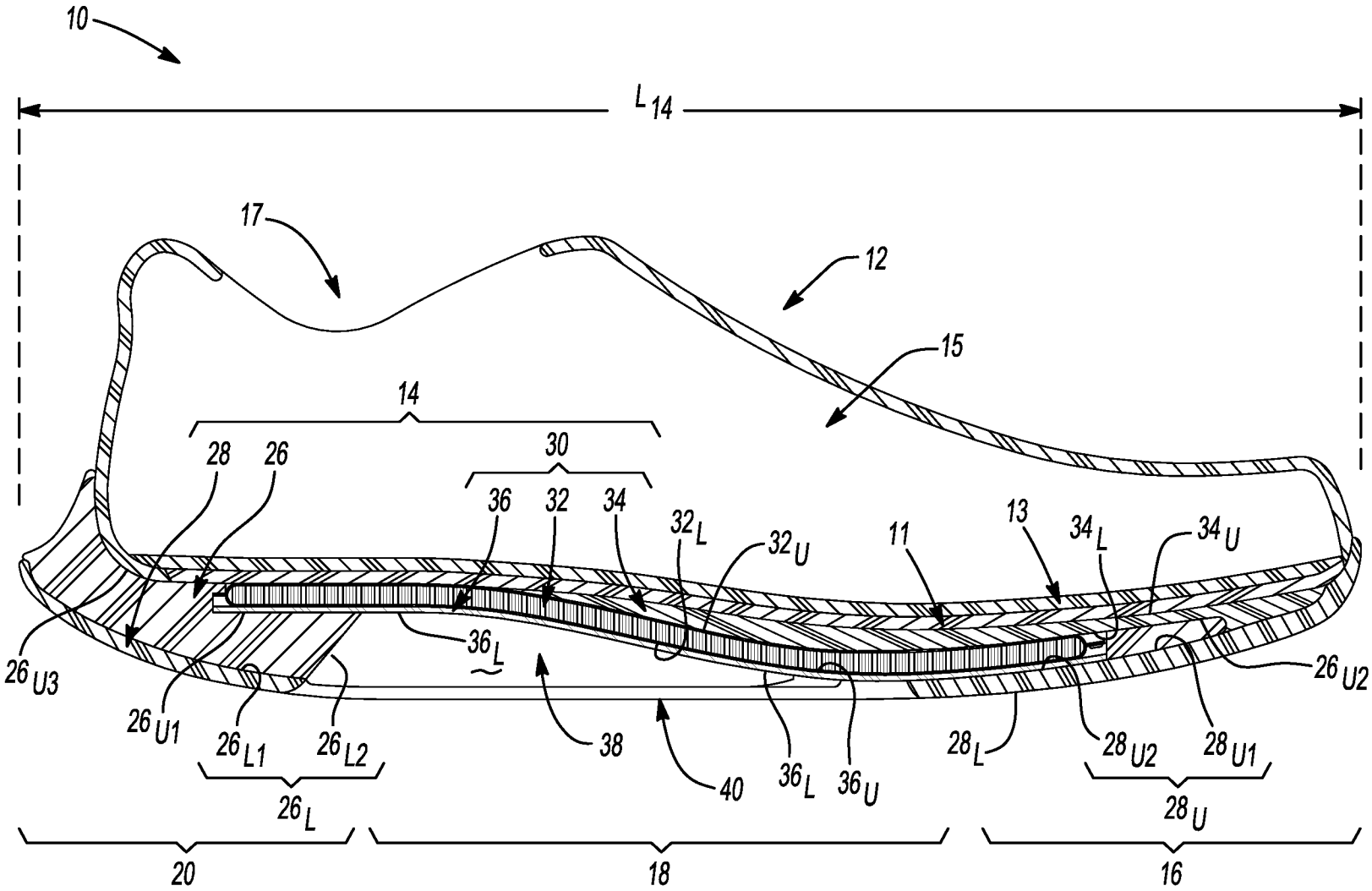
FIG. 11 is a cross-sectional view of the article of footwear of FIG. 1 taken along Line 11-11 of FIG. 1 or 10.

With reference to FIGS. 1-4, an exemplary article of footwear 10 is provided and includes an upper 12 and a sole structure 14 attached to the upper 12. As shown in FIG. 11, the article of footwear 10 may also include a strobel 11 attached to the upper 12 and an insole or sock-liner 13 disposed within a cavity 15 defined by one or more of the strobel 11 and the upper 12. The cavity 15 is sized for receiving a foot of a user by way of an ankle opening 17.

The article of footwear 10 may be divided into one or more regions. The regions may include a forefoot region 16, a midfoot region 18, and a heel region 20. The forefoot region 16 may correspond with toes and joints connecting metatarsal bones with phalanx bones of a foot. The midfoot region 18 may correspond with an arch area of the foot while the heel region 20 may correspond with rear portions of the foot, including a calcaneus bone. The article of footwear 10 may additionally include a medial side 22 and a lateral side 24 that correspond with opposite sides of the article of footwear 10 and extend through the regions 16, 18, and 20.

Figure 3:
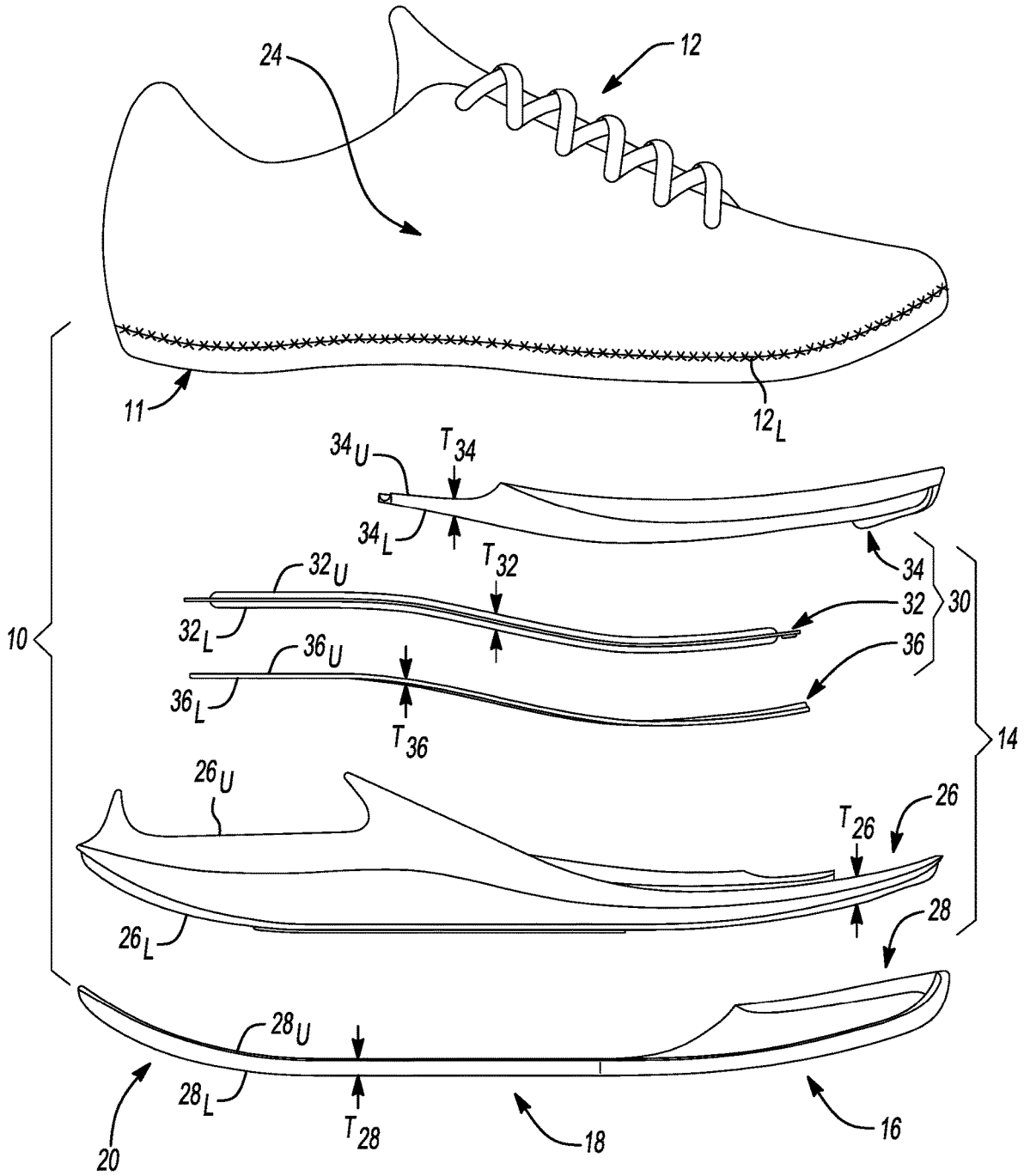
FIG. 3 is an exploded side view of the article of footwear of FIG. 1.
Figure 4:
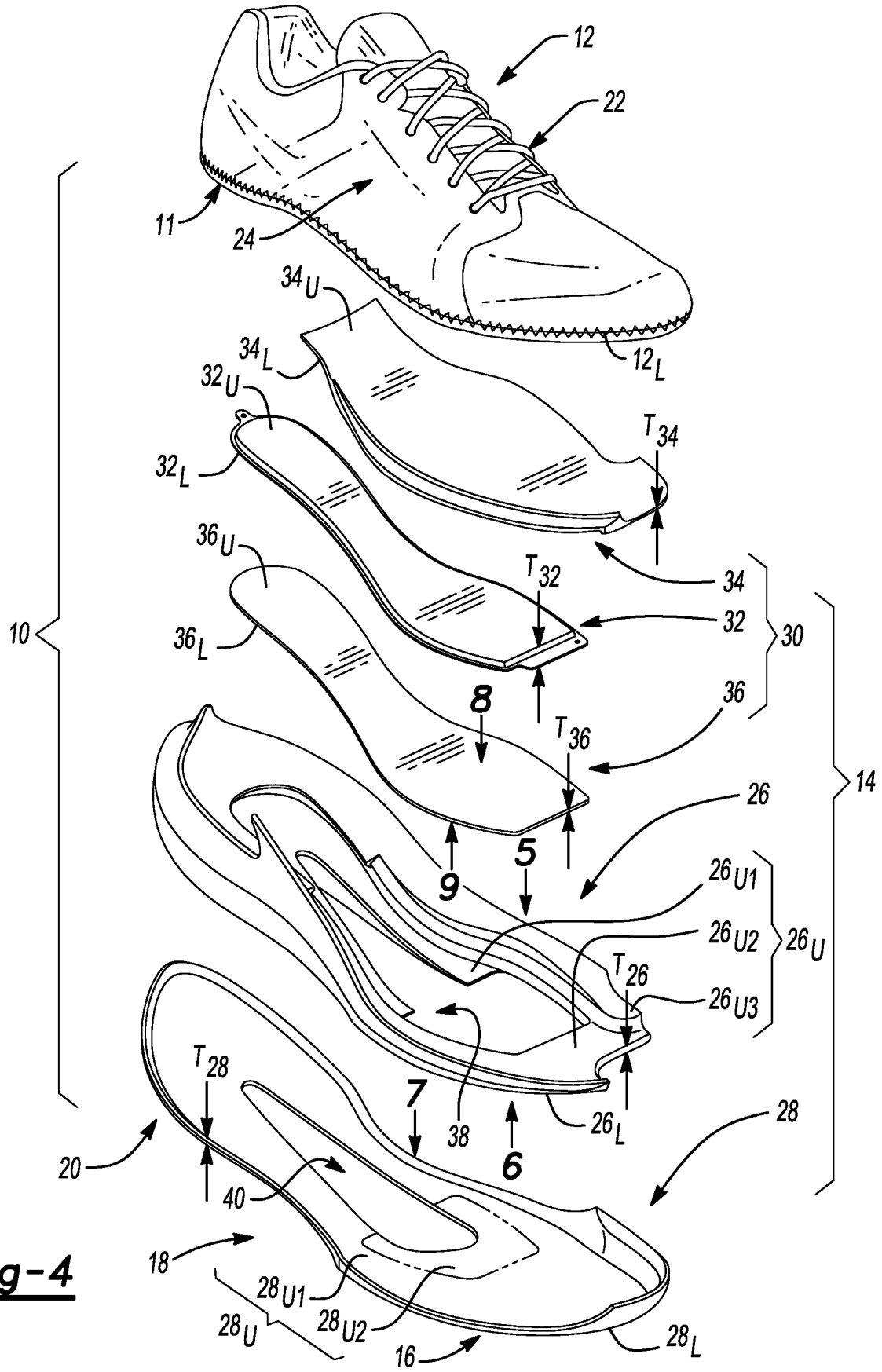
FIG. 4 is an exploded perspective view of the article of footwear of FIG. 1.

Referring to FIGS. 3, 4, and 11, the sole structure 14 may include a midsole 26, an outsole 28, and a cushioning arrangement 30. The cushioning arrangement 30 is disposed generally between the upper 12 and the outsole 28. As will be explained in the following disclosure, at least one lower surface portion (see, e.g., reference numeral $\mathbf{36}_{L1}$ in FIG. 9) of a portion (see, e.g., reference numeral 36 in FIG. 4) of the cushioning arrangement 30 is disposed directly adjacent and is directly supported by an upper surface portion (see, e.g., reference numeral $\mathbf{26}_{U1}$ in FIG. 5) of an upper surface (see, e.g., reference numeral $\mathbf{26}_{U}$) of the midsole 26. Furthermore, at least another lower surface portion (see, e.g., reference numeral $\mathbf{36}_{L2}$ in FIG. 9) of the portion (see, e.g., reference numeral 36 in FIG. 4) of the cushioning arrangement 30 directly contacts and is directly supported by an upper surface portion (see, e.g., reference numeral $\mathbf{28}_{U2}$ in FIG. 7) of the outsole 28. Even further, at least another lower surface portion (see, e.g., reference numeral 3613 in FIGS. 9 and 10) of the portion (see, e.g., reference numeral 36) of the cushioning arrangement 30 does not directly contact and is not directly supported by any upper surface portion (see, e.g., reference numeral $\mathbf{26}_{U}$, $\mathbf{28}_{U}$) of either of the midsole 26 and the outsole 28.

Figure 7:
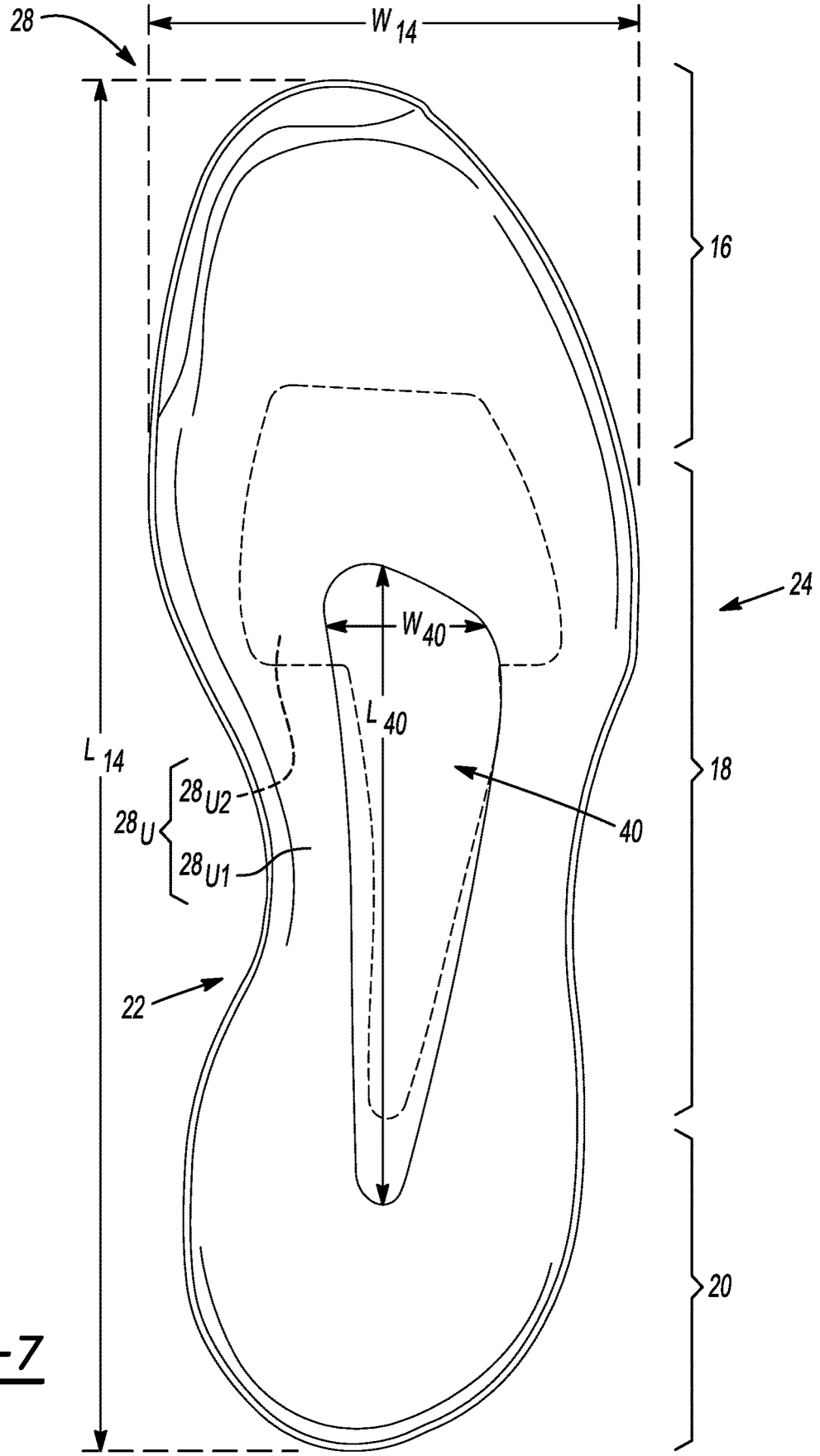
FIG. 7 is a top view of an outsole of the sole structure of FIG. 1 in the direction of arrow 7 of FIG. 4.

As shown in FIGS. 1-4, the outsole 28 extends across substantially the entire width ($W_{14}$) and the length ($L_{14}$) of the sole structure 14. However, as shown in FIGS. 4 and 7, the outsole 28 may form at least one passage 40, which will be discussed in greater detail in the following disclosure, that extends through a thickness ($T_{28}$) of the outsole 28 in order to define an opening or window that exposes or makes one or more other components of the article of footwear 10 visible. For example, one or more of the midsole 26 and/or one or more components 32, 34, 36 of the cushioning arrangement 30 may be visible through the passage 40 when the article of footwear 10 is viewed according to the direction shown in FIG. 10.

With reference to FIGS. 3 and 4, an exemplary orientation of the cushioning arrangement 30 relative to the midsole 26 is provided. The midsole 26 is defined by a thickness ($T_{26}$) extending between an upper surface $\mathbf{26}_{U}$ of the midsole 26 and a lower surface $\mathbf{26}_{L}$ of the midsole 26. In an example, the thickness ($T_{26}$) extending between the upper surface $\mathbf{26}_{U}$ of the midsole 26 and the lower surface $\mathbf{26}_{L}$ of the midsole 26 may be greater in the heel region 20 than in the forefoot region 16. Furthermore, the thickness ($T_{26}$) extending between the upper surface $\mathbf{26}_{U}$ of the midsole 26 and the lower surface $26_L$ of the midsole 26 may progressively taper as the midsole 26 extends along the length ($L_{14}$) of the sole structure 14 from the heel region 20 to the forefoot region 16 in order to, for example, bias a user wearing the article of footwear 10 in a forward camber orientation.

Figure 5:
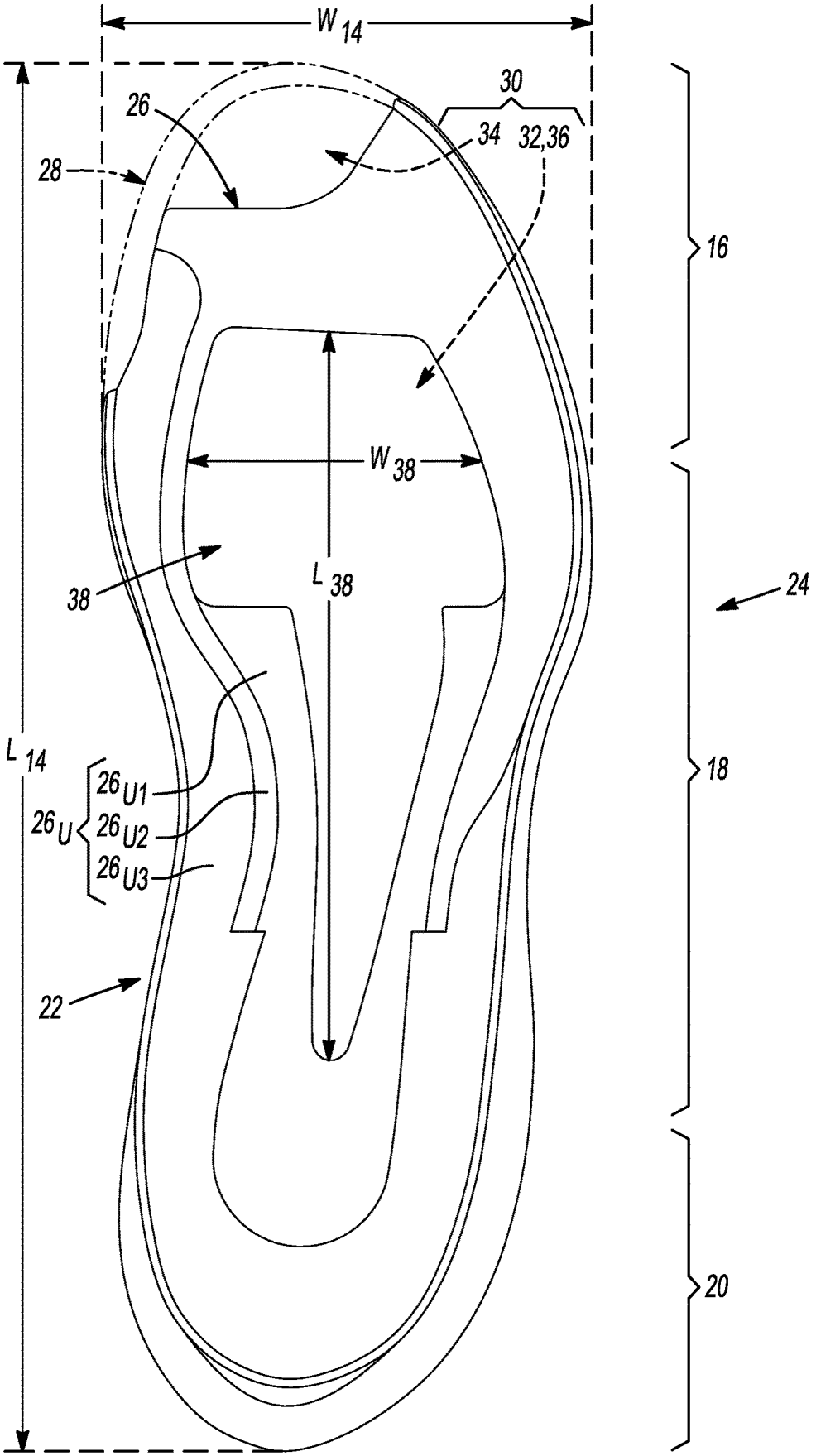
FIG. 5 is a top view of a midsole of the sole structure of FIG. 1 in the direction of arrow 5 of FIG. 4.
Figure 6:
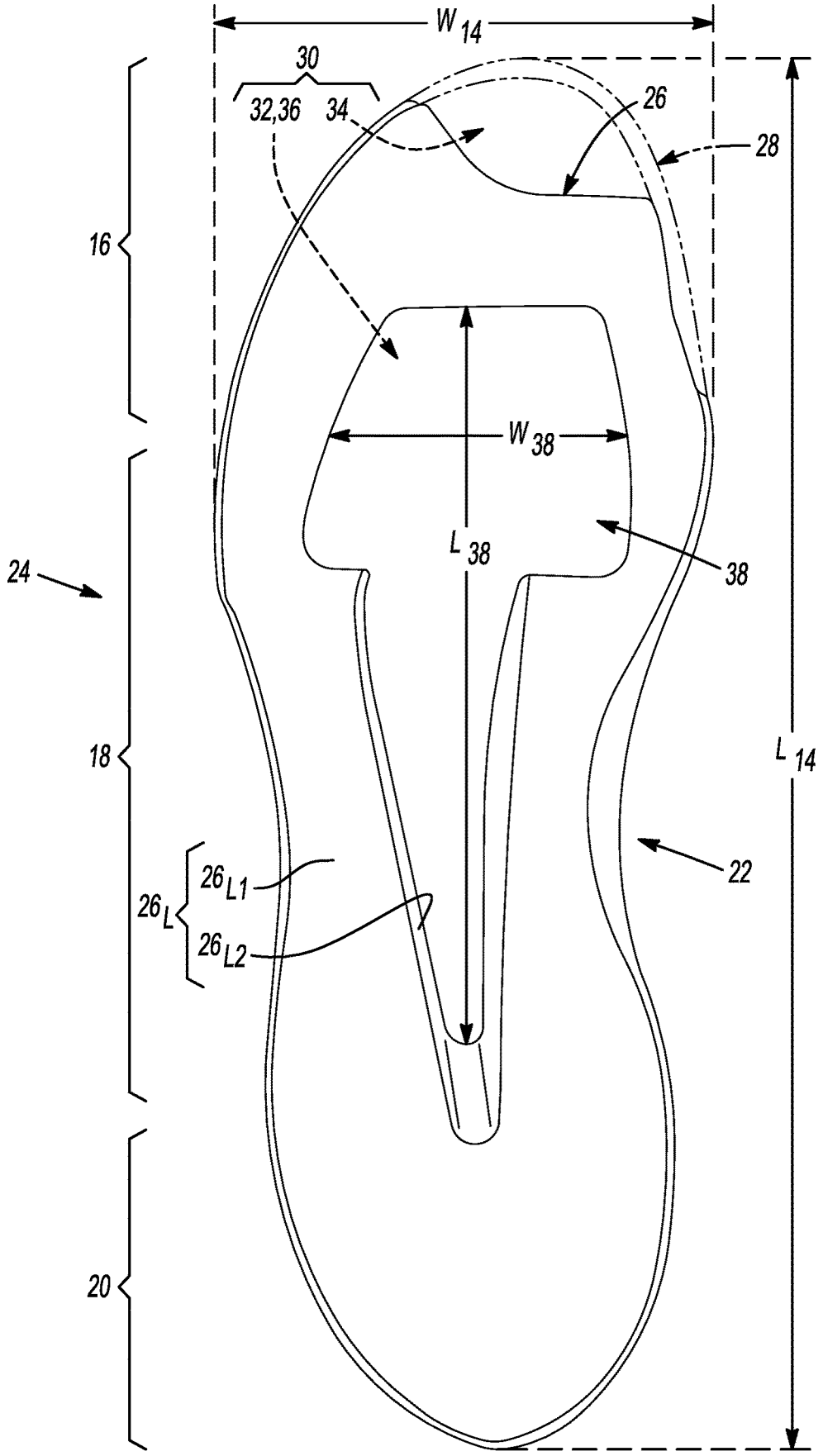
FIG. 6 is a bottom view of the midsole of FIG. 5 in the direction of arrow 6 of FIG. 4.

As shown in FIGS. 4-6, at least one passage 38 extends through the thickness ($T_{26}$) of the midsole 26 in order to define an opening or window that exposes or makes one or more other components of the article of footwear 10 visible. For example, one or more components 32, 34, 36 of the cushioning arrangement 30 may be visible at the passage 38 when the article of footwear 10 is viewed according to, for example, the view shown in FIG. 10. The at least one passage 38 may be defined by a width ($W_{38}$) and a length ($L_{38}$) that is not greater than, respectively, the width ($W_{14}$) and the length ($L_{14}$) of the sole structure 14.

A shown in FIGS. 5 and 6, the length ($L_{38}$) of the at least one passage 38 extends across most or all of the midfoot region 18 and a portion of the forefoot region 16. In one configuration, the width ($W_{38}$) of the at least one passage 38 may be greater in the forefoot region 16 than in the midfoot region 18 and may be spaced apart from the heel region 20.

Although the exemplary implementation of the midsole 26 of FIGS. 5 and 6 does not show the length ($L_{38}$) of the at least one passage 38 extending across or to the heel region 20, other implementations of the length ($L_{38}$) of the at least one passage 38 may extend across some or all of the heel region 20. In yet another implementation, although the exemplary implementation of the midsole 26 of FIGS. 5 and 6 shows the length ($L_{38}$) of the at least one passage 38 extending across some of the forefoot region 16, the length ($L_{38}$) of the at least one passage 38 may extend across all of or none of the forefoot region 16. Even further, although the exemplary implementation of the midsole 26 of FIGS. 5 and 6 shows the length ($L_{38}$) of the at least one passage 38 extending across substantially all of the midfoot region 18, the at least one passage 38 may be spaced apart from the midfoot region 18 such that the passage 38 is entirely disposed within the forefoot region 16 or the heel region 20.

With reference to FIGS. 4 and 5, the upper surface $26_U$ of the midsole 26 may be defined by a plurality of upper surface portions $26_{U1}$-$26_{U3}$. The plurality of upper surface portions $26_{U1}$-$26_{U3}$ may include, for example, a first upper surface portion $26_{U1}$, a second upper surface portion $26_{U2}$, and a third upper surface portion $26_{U3}$.

As shown in FIG. 5, the first upper surface portion $26_{U1}$ of the midsole 26 is defined by an inner-most region of the upper surface $26_U$ of the midsole 26. The first upper surface portion $26_{U1}$ of the midsole 26 may be defined by a U-shape or V-shape that extends along a portion of the heel region 20 and, further, along a portion of the midfoot region 18 that extends from the heel region 20. Furthermore, a portion of the first upper surface portion $26_{U1}$ of the midsole 26 defines a portion of the length ($L_{38}$) of the at least one passage 38 extending through the thickness of the ($T_{26}$) of the midsole 26.

As also shown in FIG. 5, the second upper surface portion $26_{U2}$ of the midsole 26 is defined by an intermediate region of the upper surface $26_U$ of the midsole 26. The second upper surface portion $26_{U2}$ of the midsole 26 may be defined by a U-shape or V-shape that extends along a portion of the forefoot region 16 and further along a portion of the midfoot region 18 that extends from the forefoot region 16. A portion of the second upper surface portion $26_{U2}$ of the midsole 26 defines a portion of the length ($L_{38}$) of the at least one passage 38 extending through the thickness of the ($T_{26}$) of the midsole 26. In an example, the width ($W_{38}$) of the at least one passage 38 is greater in a region of the upper surface $26_U$ of the midsole 26 as defined by the second upper surface portion $26_{U2}$ that is closer to the forefoot region 16 in comparison to a region of the upper surface $26_U$ of the midsole 26 as defined by the first upper surface portion $26_{U1}$ that is closer to or located within the midfoot region 18.

As also shown in FIG. 5, the third upper surface portion $26_{U3}$ of the midsole 26 is defined by an outer-most region of the upper surface $26_U$ of the midsole 26. The third upper surface portion $26_{U3}$ of the midsole 26 may be defined by (1) a portion of the second upper surface portion $26_{U2}$ of the midsole 26 and (2) a portion of the first upper surface portion $26_{U1}$ of the midsole 26. The third upper surface portion $26_{U3}$ of the midsole 26 extends along a portion of the forefoot region 16, all of the midfoot region 18, and all of the heel region 20 at the medial side 22 and extends along a portion of the midfoot region 18 and all of the heel region 20 at the lateral side 24.

With reference to FIGS. 4 and 6, the lower surface $26_L$ of the midsole 26 may be defined by a plurality of lower surface portions $26_{L1}$-$26_{L2}$. The plurality of lower surface portions $26_{L1}$-$26_{L2}$ may include, for example, a first lower surface portion $26_{L1}$ and a second lower surface portion $26_{L2}$.

As shown in FIG. 6, the first lower surface portion $26_{L1}$ of the midsole 26 is defined by an outer-most region of the lower surface $26_L$ of the midsole 26. The first lower surface portion $26_{L1}$ of the midsole 26 defines a portion of the at least one passage 38 while surrounding the second lower surface portion $26_{U2}$. The first lower surface portion $26_{L1}$ of the midsole 26 extends along a portion of the forefoot region 16, all of the midfoot region 18, and all of the heel region 20 at both the medial side 22 and the lateral side 24. Furthermore, a portion of the first lower surface portion $26_{L1}$ of the midsole 26 defines a portion of the length ($L_{38}$) of the at least one passage 38 extending through the thickness of the ($T_{26}$) of the midsole 26. In an example, the width ($W_{38}$) of the at least one passage 38 is greater in a region of the lower surface $26_U$ of the midsole 26 as defined by the first lower surface portion $26_{L1}$ that is closer to the forefoot region 16 in comparison to a region of the lower surface $26_U$ of the midsole 26 as defined by the second lower surface portion $26_{L2}$ that is closer to or located within the midfoot region 18.

As also shown in FIG. 6, the second lower surface portion $26_{L2}$ of the midsole 26 is defined by an inner-most region of the lower surface $26_U$ of the midsole 26. The second lower surface portion $26_{L2}$ of the midsole 26 may be defined by a U-shape or V-shape that extends along a portion of the heel region 20 and, further, along a portion of the midfoot region 18 that extends from the heel region 20. Furthermore, a portion of the second lower surface portion $26_{L2}$ of the midsole 26 defines a portion of the length ($L_{38}$) of the at least one passage 38 extending through the thickness of the ($T_{26}$) of the midsole 26.

As shown in FIGS. 4 and 7, an exemplary upper surface $28_U$ of the outsole 28 is shown. An exemplary lower surface $28_L$ of the outsole 28 is also shown at FIGS. 4 and 10.

With reference to FIG. 4, the outsole 28 is defined by a thickness ($T_{28}$) extending between the upper surface $28_U$ of the outsole 28 and the lower surface $28_L$ of the outsole 28. The thickness ($T_{28}$) extending between the upper surface $28_U$ of the outsole 28 and the lower surface $28_L$ of the outsole 28 may be substantially the same in each of the forefoot region 16, the midfoot region 18, and the heel region 20.

Figure 10:
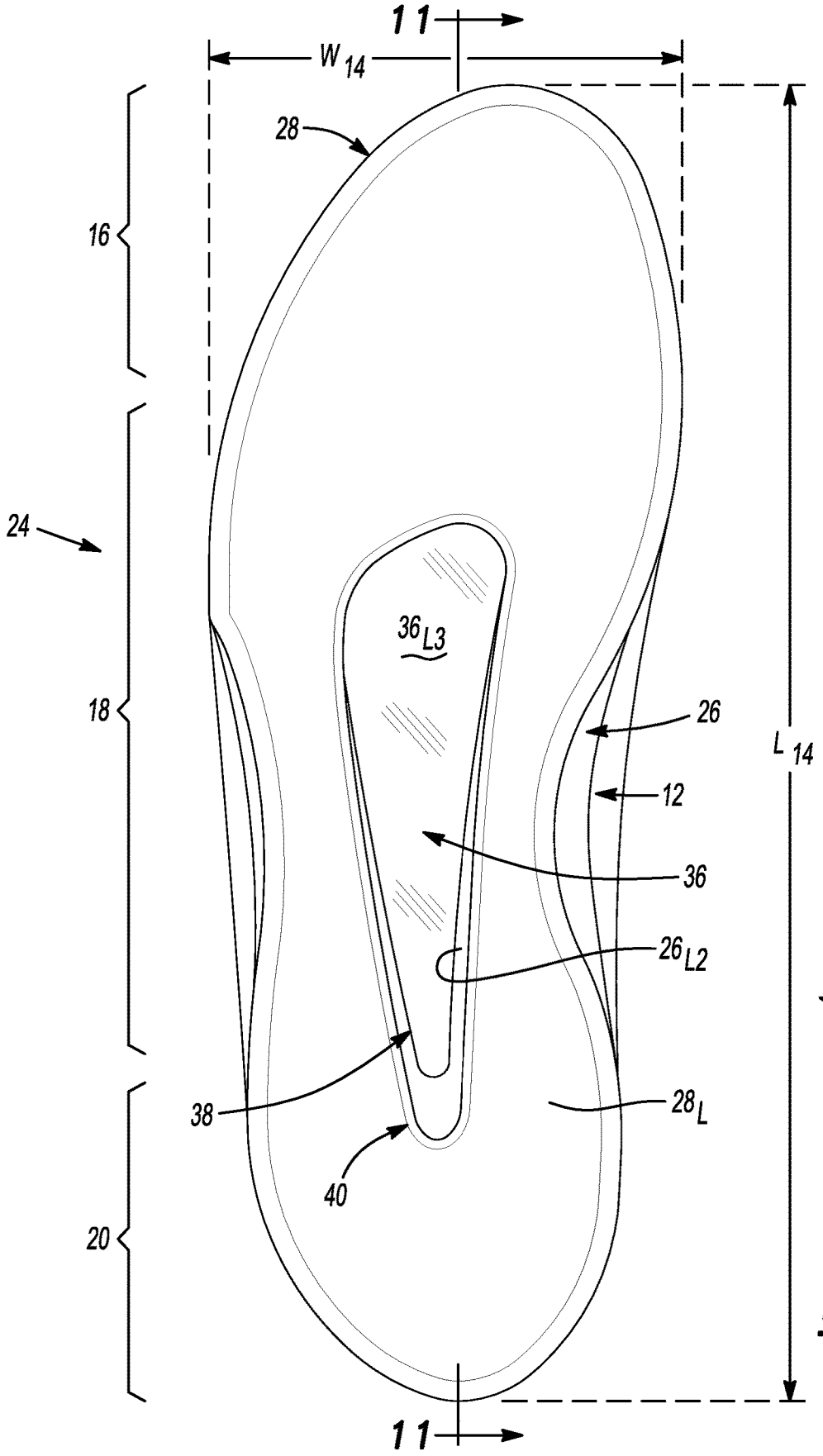
FIG. 10 is a bottom view of the article of footwear of FIG. 1 in the direction of arrow 10 of FIG. 1 or 2.

As shown in FIGS. 4, 7, and 10, at least one passage 40 extends through the thickness ($T_{28}$) of the outsole 28 in order to define an opening or window that exposes or makes one or more other components of the article of footwear 10 visible such as, for example: (1) a portion of the midsole 26 (e.g., the second lower surface portion $\mathbf{26}_{L2}$ of the midsole 26 as shown in FIG. 10); and/or (2) a portion of the cushioning arrangement 30 (e.g., a third lower surface portion $\mathbf{36}_{L3}$ of a plate member 36 as shown in FIG. 10) that does not directly contact and is not directly supported by any upper surface portion (see, e.g., reference numeral $\mathbf{26}_U$, $\mathbf{28}_U$) of either of the midsole 26 or the outsole 28. As shown in FIG. 7, the at least one passage 40 may be defined by a width ($W_{40}$) and a length ($L_{40}$) that is not greater than, respectively, the width ($W_{14}$) and the length ($L_{14}$) of the sole structure 14.

As shown in FIG. 7, the length ($L_{40}$) of the at least one passage 40 extends across a portion of the midfoot region 18 and a portion of the heel region 20. The width ($W_{40}$) of the at least one passage 40 is defined in a direction substantially perpendicular to the length ($L_{40}$) and may be greater in the midfoot region 18 proximate to the forefoot region 16 and tapers as the at least one passage 40 extends from the midfoot region 18 toward the heel region 20. As shown in FIG. 7, the at least one passage 40 is spaced apart from the forefoot region 16.

Although the exemplary implementation of the outsole 28 of FIGS. 7 and 10 does not show the length ($L_{40}$) of the at least one passage 40 extending across or to the forefoot region 16, other implementations of the length ($L_{40}$) of the at least one passage 40 may extend across some or all of the forefoot region 16. In yet another implementation, although the exemplary implementation of the outsole 28 of FIGS. 7 and 10 show the length ($L_{40}$) of the at least one passage 40 extending across a portion of the heel region 20, the length ($L_{40}$) of the at least one passage 40 may extend across all of or none of the heel region 20. Even further, although the exemplary implementation of the outsole 28 of FIGS. 7 and 10 show the length ($L_{40}$) of the at least one passage 40 extending across a portion of the midfoot region 18, the length ($L_{40}$) of the at least one passage 40 may extend across all of or none of the midfoot region 18 such that the passage 40 is entirely disposed within the forefoot region 16 or the heel region 20.

With reference to FIGS. 4 and 7, an upper surface $\mathbf{28}_U$ of the outsole 28 may be defined by a plurality of upper surface portions $\mathbf{28}_{U1}$-$\mathbf{28}_{U2}$. The plurality of upper surface portions $\mathbf{28}_{U1}$-$\mathbf{28}_{U2}$ may include, for example, a first upper surface portion $\mathbf{28}_{U1}$ and a second upper surface portion $\mathbf{28}_{U2}$.

As shown in FIG. 7, the first upper surface portion $\mathbf{28}_{U1}$ of the outsole 28 is defined by an outer-most region of the upper surface $\mathbf{28}_U$ of the outsole 28. The first upper surface portion $\mathbf{28}_{U1}$ of the outsole 28 extends along all of the forefoot region 16, all of the midfoot region 18, and all of the heel region 20 at both the medial side 22 and the lateral side 24. Furthermore, the first upper surface portion $\mathbf{28}_{U1}$ of the outsole 28 defines the length ($L_{40}$) of the at least one passage 40 extending through the thickness of the ($T_{28}$) of the outsole 28. The width ($W_{40}$) of the at least one passage 40 is greater in a region of the upper surface $\mathbf{28}_L$ of the outsole 28 as defined by the first upper surface portion $\mathbf{28}_{U1}$ that is disposed closer to the forefoot region 16 in comparison to a region of the upper surface $\mathbf{28}_U$ of the outsole 28 as defined by the first upper surface portion $\mathbf{28}_{U1}$ that is disposed closer to or located within the midfoot region 18. As such, the passage 40 tapers in a direction from the forefoot region 16 toward the heel region 20.

The second upper surface portion $\mathbf{28}_{U2}$ of the outsole 28 may be defined as a sub-region of the first upper surface portion $\mathbf{28}_{U1}$. With reference to a dashed-line perimeter in FIGS. 4 and 7, the second upper surface portion $\mathbf{28}_{U2}$ of the outsole 28 may be defined by a substantially square shape that extends along some of the midfoot region 18 near the forefoot region 16.

Referring now to FIGS. 3, 4, 8, 9, and 11, components 32, 34, 36 of the cushioning arrangement 30 are described in detail. Furthermore, an arrangement of the components 32, 34, 36 of the cushioning arrangement 30 relative the midsole 26 and the outsole 28 are also described in detail.

In an example, as shown in FIGS. 3 and 4, the cushioning arrangement 30 may include a fluid-filled chamber 32, a cushioning pad 34, and plate member 36. The fluid-filled chamber 32 may be defined by a thickness ($T_{32}$) extending between an upper surface $\mathbf{32}_U$ of the fluid-filled chamber 32 and a lower surface $\mathbf{32}_L$ of the fluid-filled chamber 32. Similarly, the cushioning pad 34 may be defined by a thickness ($T_{34}$) extending between an upper surface $\mathbf{34}_U$ of the cushioning pad 34 and a lower surface $\mathbf{34}_L$ of the cushioning pad 34. Furthermore, the plate member 36 may be defined by a thickness ($T_{36}$) extending between an upper surface $\mathbf{36}_U$ (see, e.g., FIG. 8) of the plate member 36 and a lower surface $\mathbf{36}_L$ (see, e.g., FIG. 9) of the plate member 36.

The fluid-filled chamber 32 may be formed by a first barrier sheet 31 that defines the upper surface $\mathbf{32}_U$, a second barrier sheet 33 that defines the lower surface $\mathbf{32}_L$, and a tensile member 35 (FIG. 11) disposed therebetween. The tensile member 35 may include, for example, a first tensile layer 37, a second tensile layer 39, and a plurality of tensile elements 41 extending between and connecting the first tensile layer 37 to the second tensile layer 39. After inflating the fluid-filled chamber 32, the plurality of tensile elements 41 may be placed under tension, as indicated by the plurality of substantially vertical lines shown in FIG. 11. Because the tensile layers 37, 39 are respectively attached to the sheets 31, 33, when the fluid-filled chamber 32 is inflated, the tensile elements 41 restrict the sheets 31, 33 from moving away from one another beyond a predetermined point and, as such, maintain a desired and substantially uniform shape of the fluid-filled chamber 32.

While the fluid-filled chamber 32 is described and shown as including a tensile member 35 disposed within an interior of the fluid-filled chamber 32, the fluid-filled chamber 32 could be devoid of a tensile member. In such a configuration, the interior of the fluid-filled chamber 32 would only include a volume of trapped fluid such as, for example, air.

Figure 8:
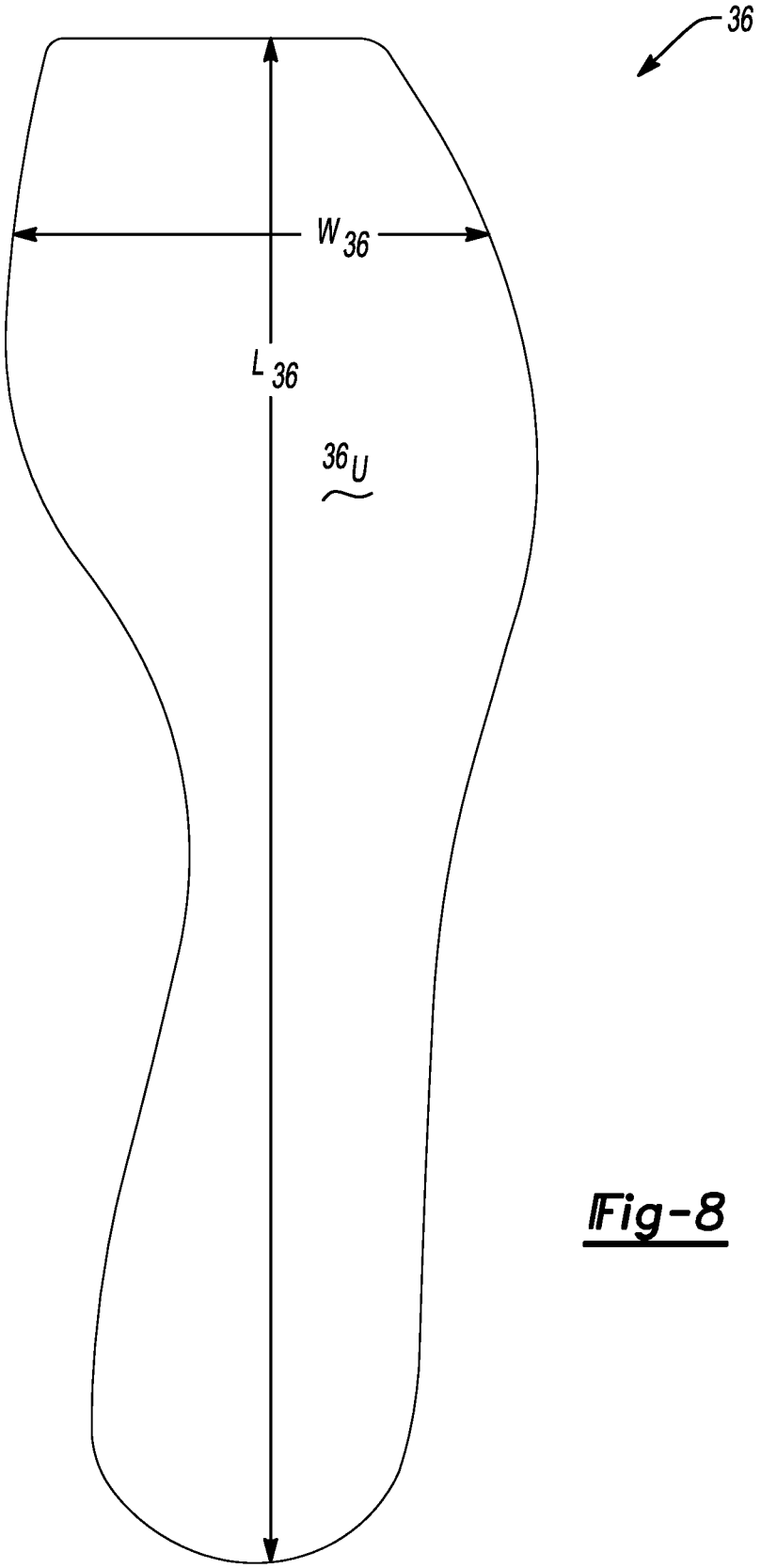
FIG. 8 is a top view of a plate member of the sole structure of FIG. 1 in the direction of arrow 8 of FIG. 4.
Figure 9:
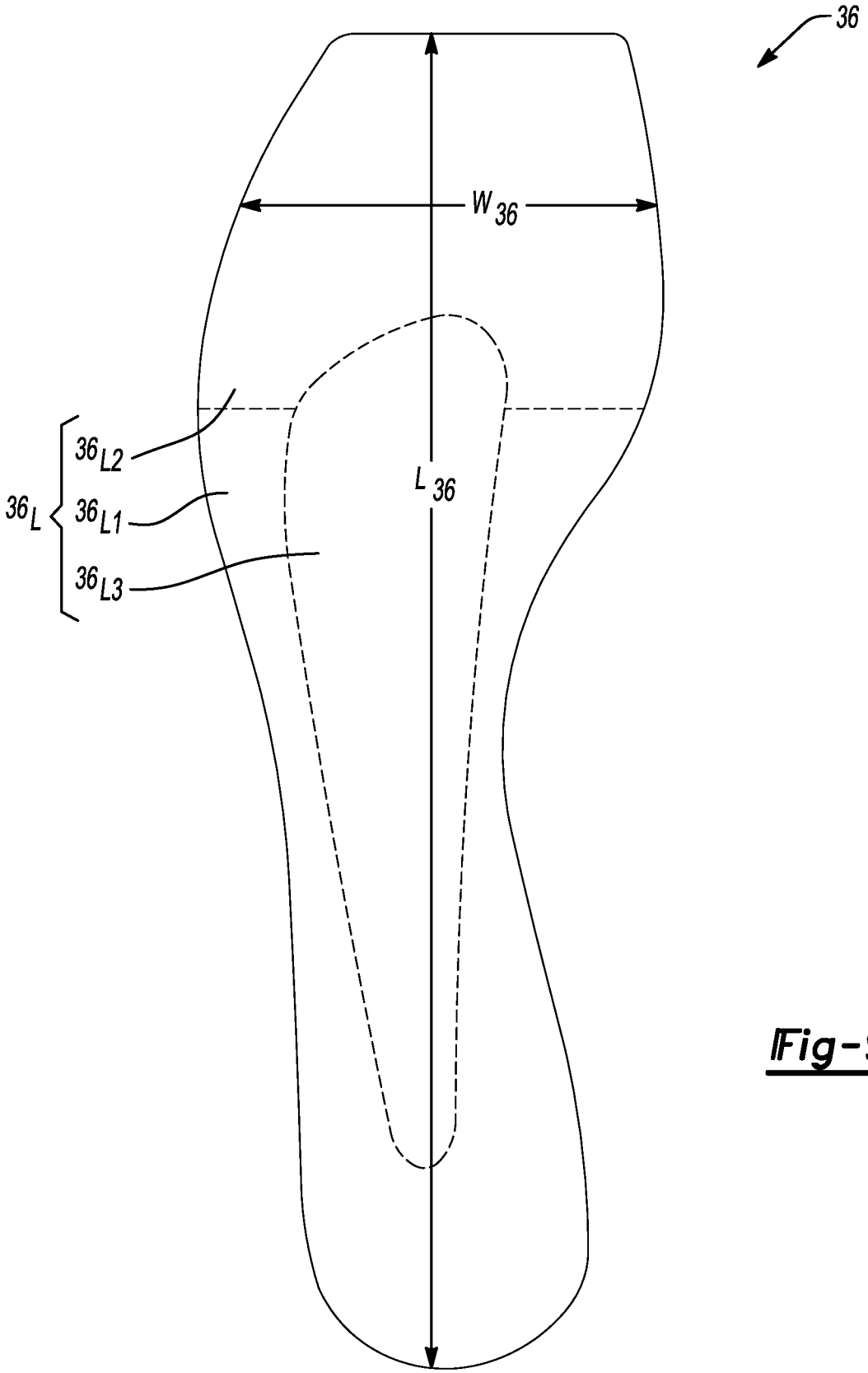
FIG. 9 is a bottom view of the plate member of FIG. 8 in the direction of arrow 9 of FIG. 4.

As shown in FIGS. 8 and 9, the plate member 36 is defined by a width ($W_{36}$) and a length ($L_{36}$) that are respectively less than the width ($W_{14}$) and the length ($L_{14}$) of the sole structure 14. When supported by the midsole 26, the length ($L_{36}$) of the plate member 36 extends along substantially all of the midfoot region 18 and partially across each of the forefoot region 16 and the heel region 20. The width ($W_{36}$) of the plate member 36 is greatest in one of the forefoot region 16 and the heel region 20 and tapers to a minimum width proximate to the middle of the midfoot region 18.

The width ($W_{36}$) and the length ($L_{36}$) of the plate member 36 may be greater than the width ($W_{38}$) and the length ($L_{38}$) of the at least one passage 38 formed by the midsole 26. Furthermore, the width ($W_{36}$) and the length ($L_{36}$) of the plate member 36 may be greater than the width ($W_{40}$) and the length ($L_{40}$) of the at least one passage 40 of the outsole 28. As such, the plate member 36 may extend completely over both passages 38, 40.

With reference to FIG. 9, the lower surface $\mathbf{36}_L$ of the plate member 36 is generally partitioned into three regions according to dashed lines. The three regions of the lower surface $36_L$ of the plate member 36 may be generally referred to as a first lower surface $36_{L1}$, a second lower surface $36_{L2}$, and a third lower surface $36_{L3}$. The first lower surface $36_{L1}$ is sized for being disposed directly adjacent and directly supported by the first upper surface portion $26_{U1}$ of the upper surface $26_U$ of the midsole 26. Furthermore, the second lower surface portion $36_{L2}$ is sized for being directly adjacent and directly supported by the second upper surface portion $28_{U2}$ of the upper surface $28_U$ of the outsole 28. A remainder of the lower surface $36_L$ of the plate member 36 that is defined by the third lower surface $36_{L3}$ of the plate member 36 does not directly contact and is not directly supported by any upper surface portion (see, e.g., reference numeral $26_U$, $28_U$) of either of the midsole 26 or the outsole 28. As a result, the third lower surface $36_{L3}$ of the plate member 36 is exposed and visible as a result of the formation and alignment of passages 38, 40 formed by the midsole 26 and the outsole 28, respectively.

The plate member 36 may be formed of a substantially transparent polyurethane material (PU) to permit one or more other components of the cushioning arrangement 30, such as, for example, the fluid-filled chamber 32, to be viewable through the passages 38, 40 formed by the midsole and the outsole 28. Furthermore, while element 36 is described as being a "plate member," the PU material of the plate member 36 may flexible (i.e., not rigid). Although the plate member 36 may be relatively flexible, the PU material defined by plate member 36 is sufficiently robust to aid in protecting the cushioning arrangement 30 from damage. Further, and in some configurations, the plate member 36 may include graphics or indicia that are viewable via the openings 38, 40.

With particular reference to FIG. 11, the assembled article of footwear 10 is provided. As shown, the sole structure 14 is attached to the upper 12 via the midsole 26 at the heel region 20 and via the outsole 28 at the forefoot region 16. Additionally, the sole structure 14 is attached to the upper 12 via the strobel 11, whereby the cushioning pad 34 is directly attached to the strobel 11 at the forefoot region 16 and the fluid-filled chamber 32 is directly attached to the strobel 11 at the heel region 20.

The cushioning pad 34 includes a tapered thickness that tapers in both a direction extending toward the heel region 20 and toward the forefoot region 16. Namely, the cushioning pad 34 includes a maximum thickness in an area disposed between a forward-most edge of the sole structure 14 and the midfoot region 18 and tapers from the area of maximum thickness both in a direction toward the forward-most edge and in a direction toward the heel region 20. Regardless of the shape of the cushioning pad 34, the cushioning pad 34 is disposed between the fluid-filled chamber 32 and the upper 12. More particularly, the cushioning pad 34 is disposed between the fluid-filled chamber 32 and the strobel 11 within the forefoot region 16 and a portion of the midfoot region 18. As such, the fluid-filled chamber 32 is spaced apart from the strobel 11 and, thus, the upper 12, by the cushioning pad 34 in the forefoot region 16 and in a portion of the midfoot region 18.

As shown in FIG. 11, the cushioning pad 34 tapers to the strobel 11 in a direction extending from the area of maximum thickness toward the heel region 20. The cushioning pad 34 tapers in this direction to an outer perimeter edge 43 of the cushioning pad 34 disposed within the midfoot region 18. At this point, the fluid-filled chamber 32 is permitted to extend in a direction toward the upper 12 and contact the strobel 11 proximate to the outer perimeter edge 43 of the cushioning pad 34. The fluid-filled chamber 32 contacts the strobel 11 within the midfoot region 18 and remains in engagement with the strobel 11 into the heel region 20.

The first barrier sheet 31 of the fluid-filled chamber 32 is in contact with the cushioning pad 34 within the forefoot region 16 and within the midfoot region 18 up to the outer perimeter edge 43. At this point, the first barrier sheet 31 engages the strobel 11 and remains in contact with the strobel 11 into the heel region 20.

The foregoing relationship between the fluid-filled chamber 32, the cushioning pad 34, and the strobel 11 provides the fluid-filled chamber 32 with a substantially arcuate shape—in longitudinal cross-section—that permits the fluid-filled chamber 32 to be disposed closer to the upper 12 within the heel region 20 as compared to the forward-most portion of the fluid-filled chamber 32 located within the forefoot region 16. This configuration provides the sole structure 14 and, thus, the article of footwear 10, with the ability to provide a wearer with a forward camber effect that urges the wearer to move in a forward direction. In addition, because the cushioning pad 34 may be formed from a cushioning material such as, for example, expanded foam, the cushioning pad 34 provides a degree of added cushioning that aids a wearer during an athletic movement such as running.

The foregoing description of the embodiments has been provided for purposes of illustration and description. It is not intended to be exhaustive or to limit the disclosure. Individual elements or feature of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An article of footwear comprising:

an upper which defines a void to receive a foot of a wearer;

a fluid-filled chamber having a constant thickness extending continuously from a first end to a second end and including a first portion at the first end in contact with the upper in a first region; and a cushioning pad including a first portion at the second end disposed between the fluid-filled chamber and the upper in a second region.

2. The article of footwear of claim 1, wherein the first region is a heel region of the article of footwear and the second region is a forefoot region of the article of footwear.

3. The article of footwear of claim 1, wherein the first portion of the fluid-filled chamber is in contact with a strobel of the upper in the first region.

4. The article of footwear of claim 3, wherein the fluid-filled chamber is spaced apart from the strobel in the second region by the cushioning pad.

5. The article of footwear of claim 1, wherein the fluid-filled chamber includes an arcuate shape in a direction extending from a heel region of the article of footwear toward a forefoot region of the article of footwear.

6. The article of footwear of claim 1, wherein the fluid-filled chamber is disposed closer to the upper within a heel region of the article of footwear than in a forefoot region of the article of footwear.

7. The article of footwear of claim 1, further comprising a tensile element disposed within the fluid-filled chamber.

8. The article of footwear of claim 1, further comprising a ground-contacting surface, at least a portion of the fluid-filled chamber being visible at an opening of the ground-contacting surface.

9. An article of footwear comprising:

an upper including a strobel which defines a void to receive a foot of a wearer; and a fluid-filled chamber having a constant thickness extending continuously from a first end to a second end and including a first portion at the first end in contact with the strobel and a second portion at the second end spaced apart from the strobel.

10. The article of footwear of claim 9, further comprising a cushioning pad including a first portion disposed between the second portion of the fluid-filled chamber and the strobel.

11. The article of footwear of claim 9, wherein the first portion is disposed in a heel region of the article of footwear and the second portion is disposed in a forefoot region of the article of footwear.

12. The article of footwear of claim 9, wherein the fluid-filled chamber includes an arcuate shape in a direction extending from a heel region of the article of footwear toward a forefoot region of the article of footwear.

13. The article of footwear of claim 9, wherein the fluid-filled chamber is disposed closer to the upper within a heel region of the article of footwear than in a forefoot region of the article of footwear.

14. The article of footwear of claim 9, further comprising a tensile element disposed within the fluid-filled chamber.

15. The article of footwear of claim 9, further comprising a ground-contacting surface, at least a portion of the fluid-filled chamber being visible at an opening of the ground-contacting surface.

16. The article of footwear of claim 9, wherein the fluid-filled chamber extends continuously from the first portion to the second portion.

17. The article of footwear of claim 1, further comprising a plate disposed adjacent to the fluid-filled chamber on an opposite side from the cushioning pad.

18. The article of footwear of claim 1, further comprising a midsole including an upper surface portion defining a recess, the cushioning pad being received within the recess and including an upper surface flush with the upper surface portion of the midsole.

19. The article of footwear of claim 10, further comprising a midsole including an upper surface portion defining a recess, the cushioning pad received within the recess and including an upper surface flush with the upper surface portion of the midsole.

20. The article of footwear of claim 19, further comprising a plate disposed between the fluid-filled chamber and the midsole at the first portion and the second portion.

* * * * *